US007586448B2

(12) United States Patent
Wei

(10) Patent No.: US 7,586,448 B2
(45) Date of Patent: Sep. 8, 2009

(54) MULTI-FREQUENCY ANTENNA

(75) Inventor: Shen-Pin Wei, Taipei Hsien (TW)

(73) Assignee: Wistron NeWeb Corporation, Hsi-Chih, Taipei Hsien (TW)

( * ) Notice: Subject to any disclaimer, the term of this patent is extended or adjusted under 35 U.S.C. 154(b) by 186 days.

(21) Appl. No.: 11/770,728

(22) Filed: Jun. 28, 2007

(65) Prior Publication Data

US 2008/0129603 A1 Jun. 5, 2008

(30) Foreign Application Priority Data

Dec. 4, 2006 (TW) ..... 95145044 A

(51) Int. Cl.
*H01Q 1/24* (2006.01)

(52) U.S. Cl. ..... 343/702; 343/700 MS

(58) Field of Classification Search ..... 343/702, 343/700 MS, 846

See application file for complete search history.

(56) References Cited

U.S. PATENT DOCUMENTS

| | | | | |
|---|---|---|---|---|
| 7,034,754 | B2 * | 4/2006 | Hung et al. | 343/700 MS |
| 7,280,074 | B1 * | 10/2007 | Chi et al. | 343/700 MS |
| 7,286,090 | B1 * | 10/2007 | Rowell | 343/702 |
| 2004/0066334 | A1 | 4/2004 | Fang et al. | |
| 2004/0125030 | A1 * | 7/2004 | Sung et al. | 343/702 |
| 2007/0040750 | A1 * | 2/2007 | Tai et al. | 343/700 MS |
| 2007/0164909 | A1 * | 7/2007 | Ogawa et al. | 343/702 |

* cited by examiner

*Primary Examiner*—Hoang V Nguyen
(74) *Attorney, Agent, or Firm*—Winston Hsu

(57) ABSTRACT

A multi-frequency antenna includes a feeding element, a first U-shaped radiator, a second U-shaped radiator, a grounding element and a coupling element. The first U-shaped radiator is coupled to the feeding element and forms a first gap toward the feeding element. The second U-shaped radiator is coupled to the feeding element and forms a second gap toward the first U-shaped radiator. The grounding element is coupled to a ground end. The coupling element is coupled between the feeding element and the grounding element.

25 Claims, 16 Drawing Sheets

Fig. 1 Proir art

| Frequency | Max. Gain | Position | Min. Gain | Position | Average Gain |
|---|---|---|---|---|---|
| 2412 (MHz) | 1.17 dB | 63.00 deg | -10.71 dB | 342.01 deg | -2.12 dB |
| 2437 (MHz) | 1.31 dB | 146.97 deg | -11.96 dB | 342.01 deg | -2.15 dB |
| 2462 (MHz) | 1.24 dB | 30.00 deg | 13.41 dB | 342.01 deg | -2.28 dB |
| 4900 (MHz) | 1.23 dB | 30.00 deg | -8.56 dB | 131.99 deg | 3.11 dB |
| 5150 (MHz) | 1.58 dB | 167.98 deg | -19.29 dB | 318.00 deg | 3.56 dB |
| 5350 (MHz) | 1.18 dB | 168.01 deg | 10.56 dB | 314.99 deg | 2.49 dB |
| 5470 (MHz) | 1.36 dB | 249.00 deg | -9.00 dB | 314.99 deg | 2.65 dB |
| 5725 (MHz) | 2.25 dB | 249.00 deg | -7.73 dB | 311.98 deg | -2.07 dB |
| 5875 (MHz) | 1.73 dB | 251.99 deg | -9.18 dB | 6.02 deg | 2.31 dB |

Fig. 8

| Frequency | Max. Gain | Position | Min. Gain | Position | Average Gain |
|---|---|---|---|---|---|
| 2412 (MHz) | 1.17 dB | 327.02 deg | 9.67 dB | 126.00 deg | -4.27 dB |
| 2437 (MHz) | -0.98 dB | 33.02 deg | -9.51 dB | 128.99 deg | 3.70 dB |
| 2462 (MHz) | 0.51 dB | 75.00 deg | 8.72 dB | 131.99 deg | -3.79 dB |
| 4900 (MHz) | .048 dB | 162.00 deg | -10.95 dB | 272.99 deg | 5.01 dB |
| 5150 (MHz) | 2.90 dB | 165.01 deg | 13.66 dB | 231.01 deg | -3.76 dB |
| 5350 (MHz) | 2.57 dB | 165.01 deg | -12.45 dB | 234.00 deg | -4.04 dB |
| 5470 (MHz) | 2.30 dB | 170.98 deg | -12.58 dB | 234.01 deg | 3.79 dB |
| 5725 (MHz) | 2.70 dB | 171.01 deg | 10.11 dB | 234.00 deg | -3.12 dB |
| 5875 (MHz) | 3.53 dB | 179.98 deg | 12.13 dB | 237.01 deg | 3.47 dB |

Fig. 9

MULTI-FREQUENCY ANTENNA

BACKGROUND OF THE INVENTION

1. Field of the Invention

The present invention relates to a multi-frequency antenna, and more particularly, to a multi-frequency antenna for use in a wireless local area network system.

2. Description of the Prior Art

An antenna is utilized to radiate or receive electromagnetic waves for transmission or reception of radio frequency signals. For an electronic product with communications functions of a wireless local area network (WLAN), such as a notebook, there is commonly a built-in antenna utilized to access the WLAN system. With the advance of the wireless communication technologies, various wireless communications systems may adopt different operating frequencies. For example, the wireless LAN standard IEEE 802.11a developed by the Institute of Electrical and Electronics Engineers (IEEE) adopts a central frequency of about 5 GHz, and the evolution of the standard IEEE 802.11, IEEE 802.11b, adopts a central frequency of about 2.4 GHz. Therefore, for the purpose of convenience for users to access a WLAN, an ideal, single antenna should be able to operate for multi-frequency bands utilized by different WLAN systems. In addition, the size of the antenna should be designed as small size as possible to catch up with the tendency of miniaturization in wireless communications facilities.

Please refer to FIG. 1, which is a schematic diagram of an inverted-F planar multi-frequency antenna 10 according to the prior art. The planar multi-frequency antenna 10 includes an interconnecting element 12, a planar radiating element 14 and a planar grounding element 16. The interconnecting element 12 has a connecting terminal 20 coupled to a feeding wire 18, for feeding signals into the planar radiating element 14. The planar radiating element 14 and the planar grounding element 16 generate electromagnetic waves, and thereby a metal bar P1 of the planar radiating element 14 is utilized to radiate higher frequency electromagnetic waves and a metal bar P2 thereof radiates lower frequency electromagnetic waves.

As known well in the art, a conducting path of an antenna is preferred to be longer than or approximate to ¼ wavelength of the radiating wave. With the ¼ wavelength limitation, the planar radiating element 14 mostly occupies a certain planar space such that the planar multi-frequency antenna 10 cannot be reduced in size effectively, which is inadequate for requirements of miniaturization.

SUMMARY OF THE INVENTION

It is therefore a primary object of the present invention to provide a multi-frequency antenna.

The present invention discloses a multi-frequency antenna. The multi-frequency antenna includes a feeding element, a first U-shaped radiator, a second U-shaped radiator, a grounding element and a coupling element. The first U-shaped radiator is coupled to the feeding element and forms a first gap toward the feeding element. The second U-shaped radiator is coupled to the feeding element and forms a second gap toward the first U-shaped radiator. The grounding element is coupled to a ground end. The coupling element is coupled between the feeding element and the grounding element.

These and other objectives of the present invention will no doubt become obvious to those of ordinary skill in the art after reading the following detailed description of the preferred embodiment that is illustrated in the various figures and drawings.

BRIEF DESCRIPTION OF THE DRAWINGS

FIG. 8 is a measured result of the multi-frequency antenna according to FIG. 2 for average gain in a horizontal plane.

FIG. 9 is a measured result of the planar multi-frequency antenna according to FIG. 1 for average gain in a horizontal plane.

DETAILED DESCRIPTION

Figure 1:
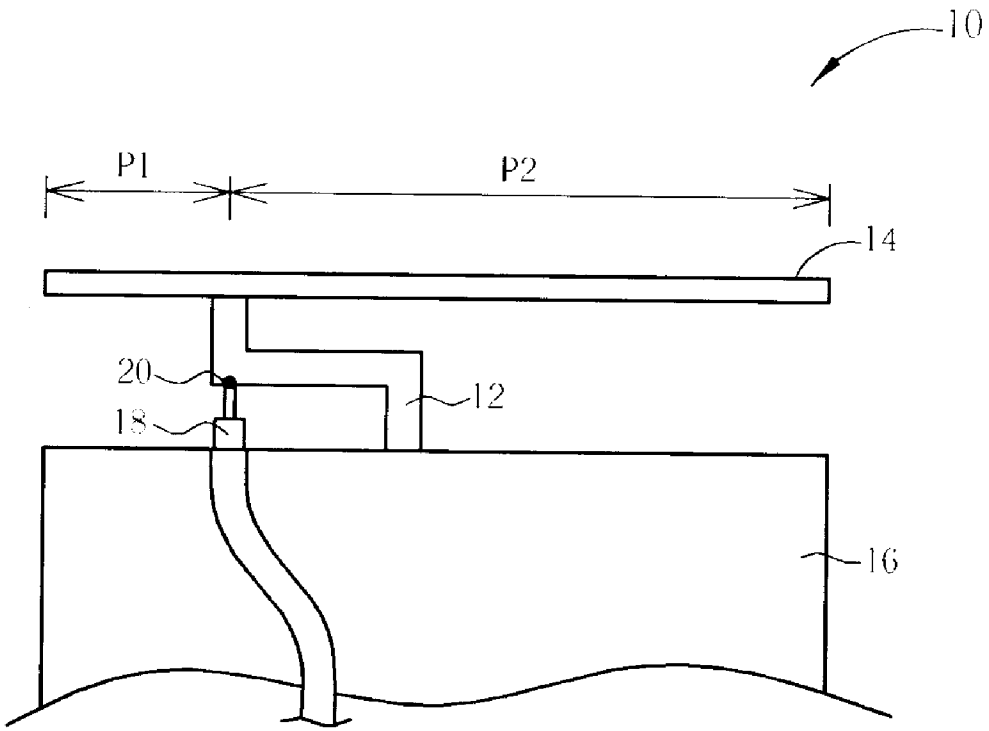
FIG. 1 is a schematic diagram of an inverted-F planar multi-frequency antenna according to the prior art.
Figure 2:
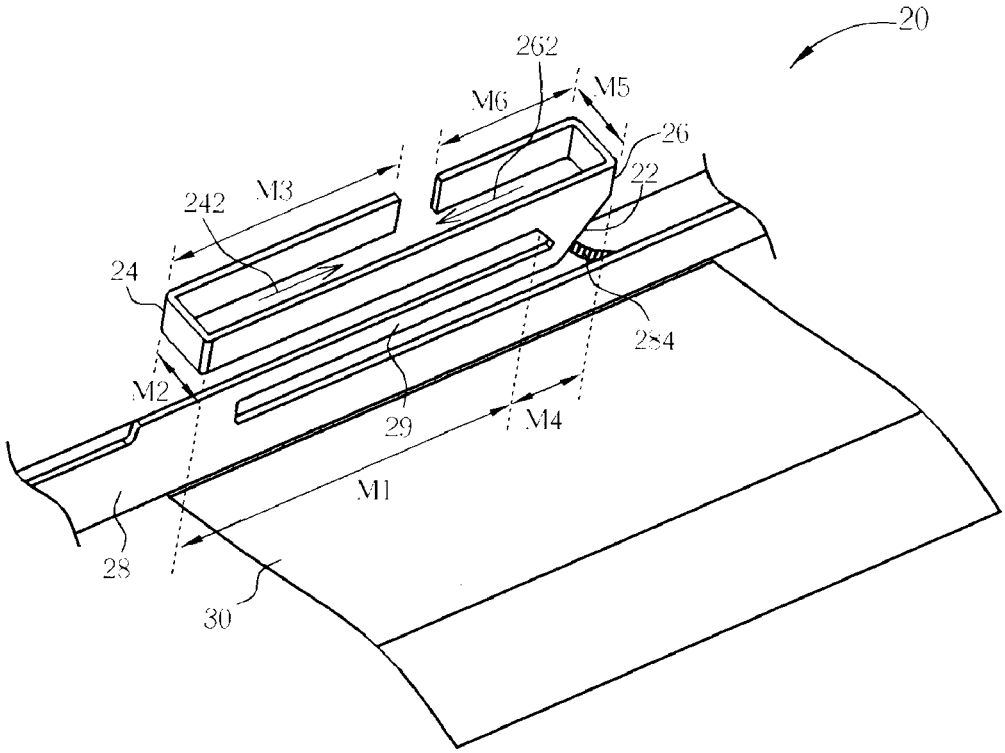
FIG. 2 is a schematic diagram of a multi-frequency antenna according to an embodiment of the present invention.
Figure 3:
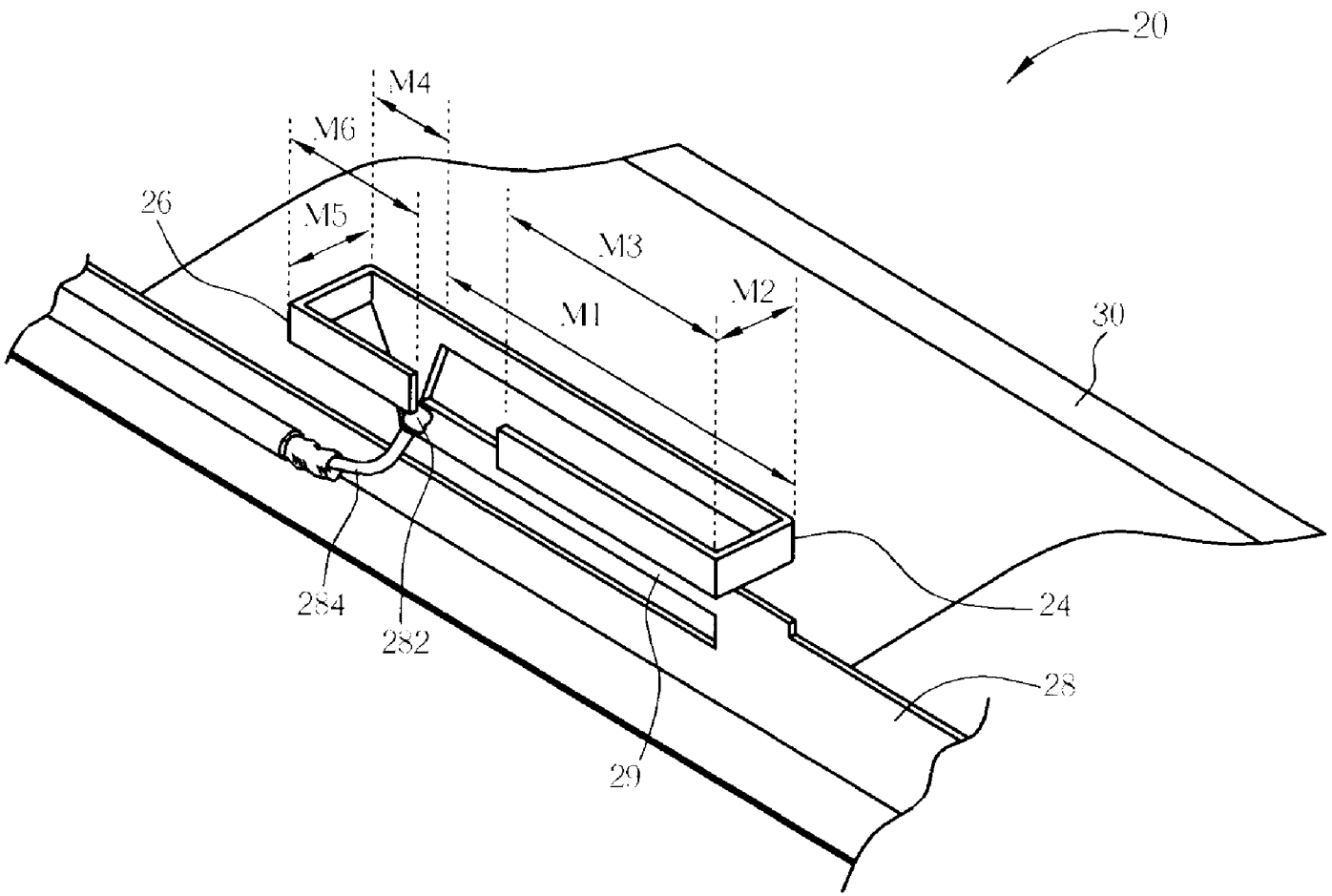
FIG. 3 is a schematic diagram of the multi-frequency antenna according to FIG. 2 from a different view.
Figure 4:
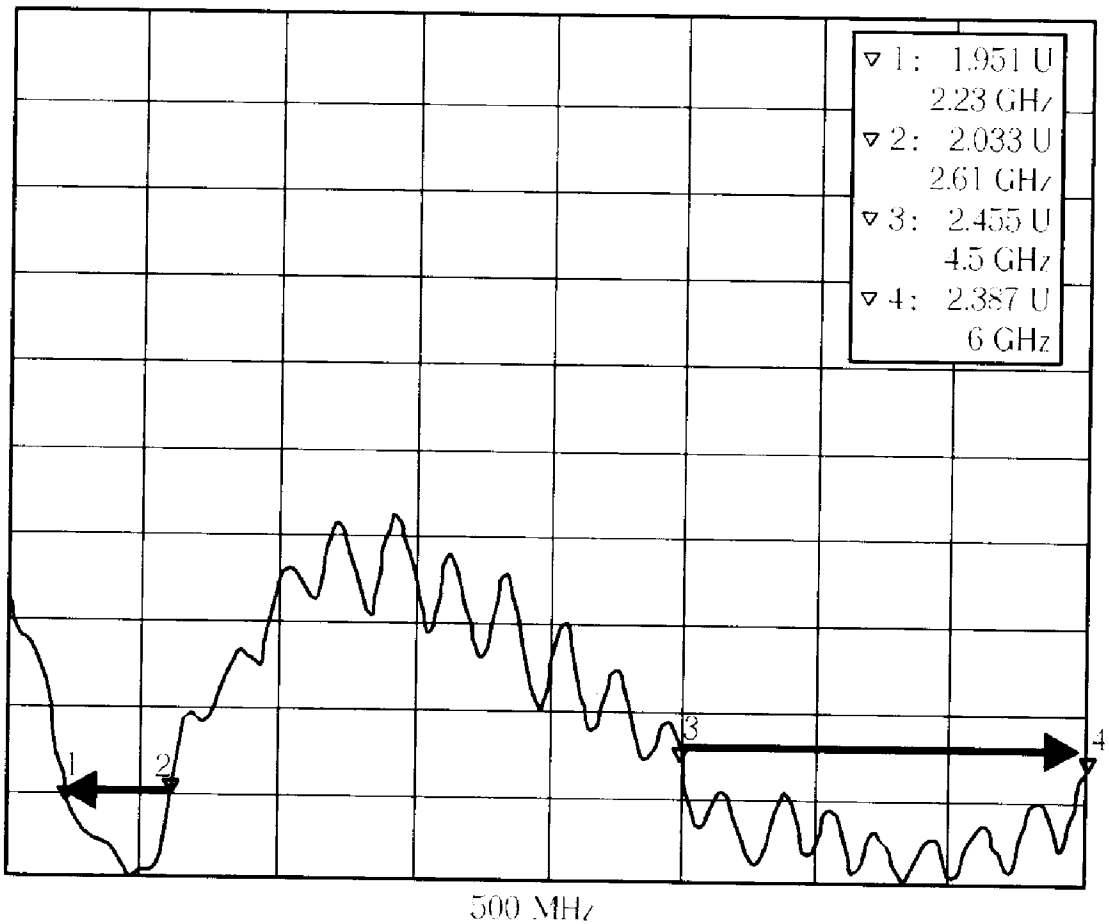
FIG. 4 is a measured result of a VSWR experiment using the multi-frequency antenna according to FIG. 2.
Figure 5:
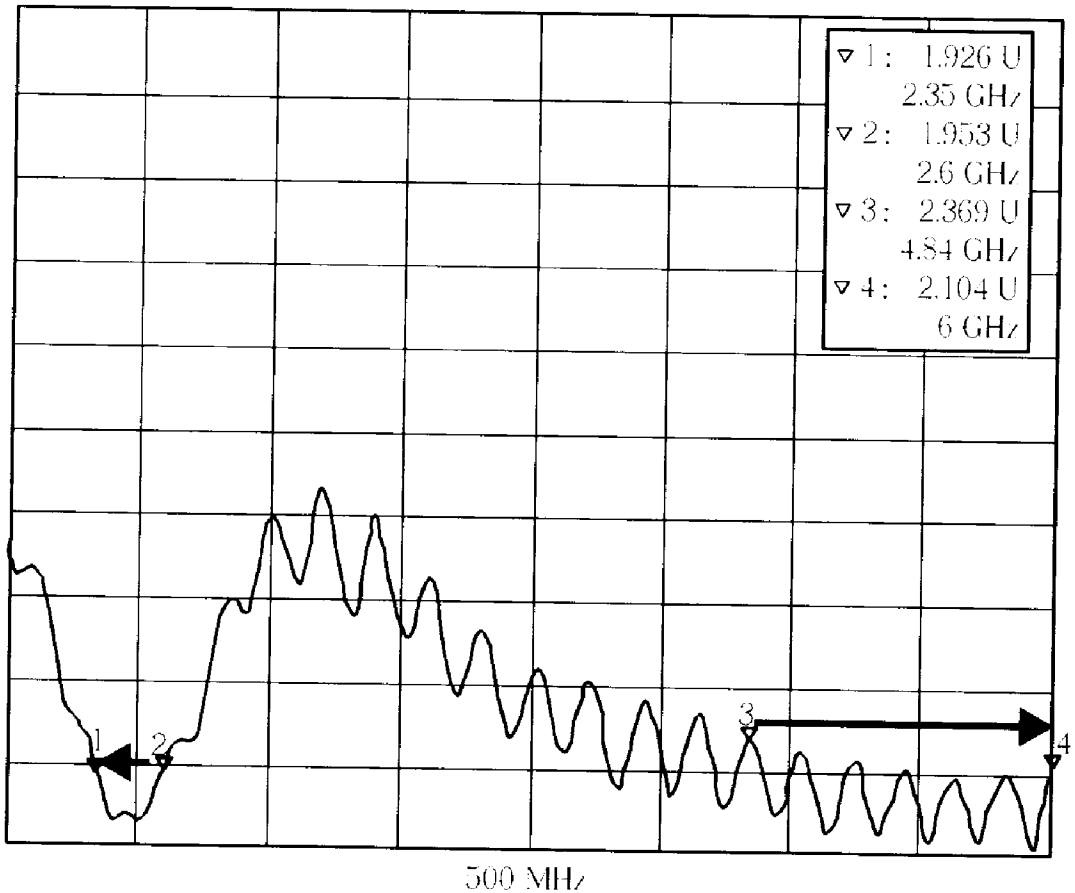
FIG. 5 is a measured result of a VSWR experiment using the planar multi-frequency antenna according to FIG. 1.

Please refer to FIG. 2 and FIG. 3, which are schematic diagrams of a multi-frequency antenna 20 from different views according to an embodiment of the present invention. The multi-frequency antenna 20 includes a feeding element 22, a first U-shaped radiator 24, a second U-shaped radiator 26, a grounding element 28 and a coupling element 29. The feeding element 22 can be a bow-tie shape. The first U-shaped radiator 24 is coupled to the feeding element 22 and forms a first gap 242 toward the feeding element 22. The second U-shaped radiator 26 is coupled to the feeding element 22, and forms a second gap 262 toward the first gap 242. The grounding element 28 is coupled to a feeding point 282 of the feeding element 22 by a feeding wire 284 feeding signals into the first U-shaped radiator 24 and the second U-shaped radiator 26. The multi-frequency antenna 20 can further include a conduction tape 30 fittingly coupled to the bottom of the grounding element 28.

In FIG. 2, the first U-shaped radiator 24 is formed by bending a metal bar or by coupling multiple metal bars jointly, seen as a combination of metal bars M1, M2 and M3. The metal bar M1, M2 and the metal bar M2, M3 form an angle of 90°, respectively. That is, the metal bar M2 and the metal bar M1 are set perpendicularly to each other, and the metal bar M3 and the metal bar M1 are parallel. Similarly, the second U-shaped radiator 26 can be considered as a combination of metal bars M4, M5 and M6. The metal bar M4, M5 and the metal bar M5, M6 also form a angle of 90°, respectively, indicating that the metal bar M5 is perpendicular to the metal bar M4, and the metal bar M6 is parallel to the metal bar M4. Thus, as can be seen in FIG. 2, the first gap 242 and the second gap 262 stretch in parallel and face-to-face directions. The multi-frequency antenna 20 can simultaneously be applied to the wireless LAN standards IEEE 802.11a and IEEE 802.11b. The first U-shaped radiator 24 is utilized to transmit signals conforming to the wireless LAN standard IEEE 802.11b adopting a central frequency of about 2.4 GHz, and the second U-shaped radiator 26 is utilized to transmit signals conforming to the wireless LAN standard IEEE 802.11a adopting a central frequency of about 5 GHz.

FIG. 4-13 are measured results of the multi-frequency antenna 20 and the planar multi-frequency antenna 10 for four different experiments. For the multi-frequency antenna 20 in the following experiments, the metal bars M1-M3 of the first U-shaped radiator 24 is implemented as being 16 mm, 2.5 mm and 10 mm long, respectively. In addition, the metal bars M4-M6 of the second U-shaped radiator 24 respectively have lengths of 4 mm, 2.5 mm and 5 mm. All of the metal bars M1-M6 have a width of 2 mm. Please refer to FIG. 4 and FIG. 5, which are charts of voltage standing wave ratio (VSWR) performance according to the multi-frequency antenna 20 and the planar multi-frequency antenna 10. As can be seen from the frequency band of 2.4 GHz in FIG. 4 and FIG. 5, the multi-frequency antenna 20 has a lower frequency bandwidth of about 380 MHz, and the planar multi-frequency antenna 10 has a lower frequency bandwidth of about 250 MHz in a condition of 2:1 VSWR. As for the frequency band of 5 GHz, the multi-frequency antenna 20 has a higher frequency bandwidth of about 1500 MHz, whereas the planar multi-frequency antenna 10 has a higher frequency bandwidth of about 1160 MHz in a condition of 2.5:1 VSWR. Obviously, regardless of the frequency band of 2.4 GHz or 5 GHz, the multi-frequency antenna 20 has wider bandwidths than the planar multi-frequency antenna 10 does.

Figure 6:
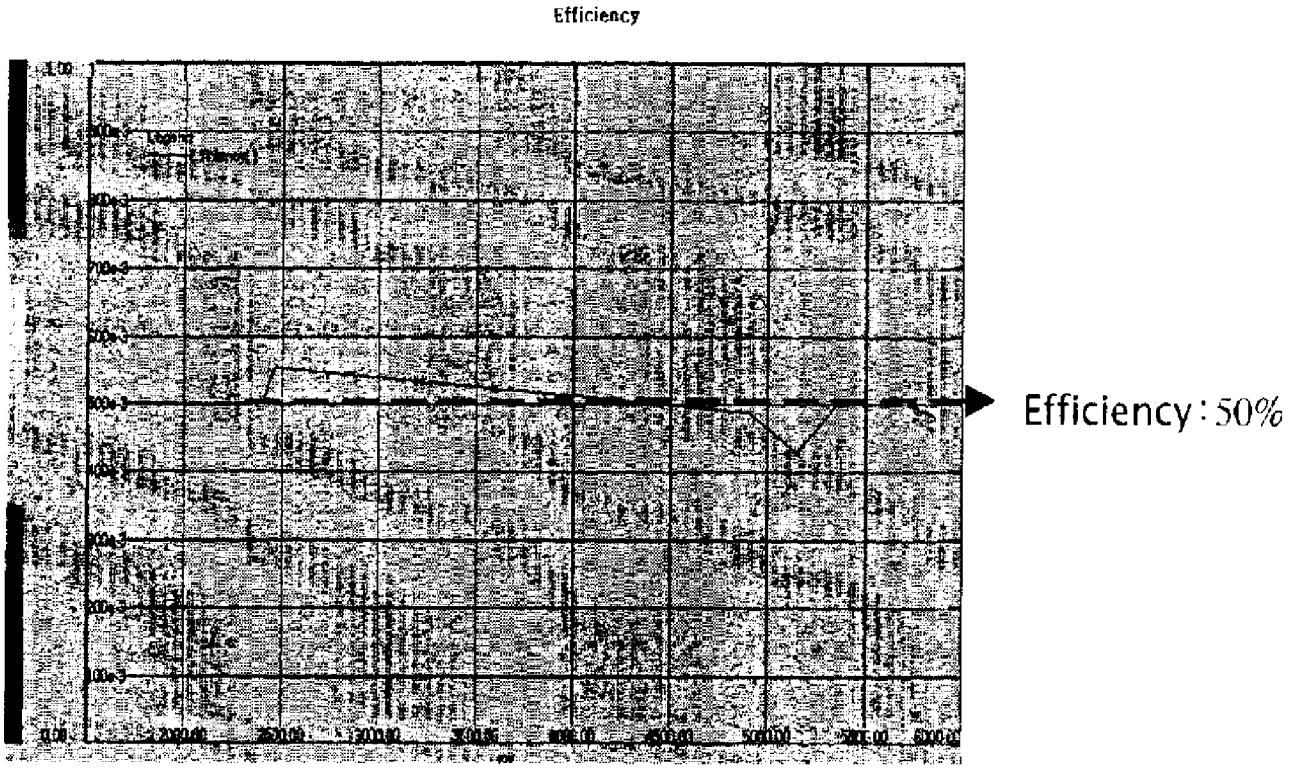
FIG. 6 is a radiation pattern of the multi-frequency antenna according to FIG. 2.
Figure 7:
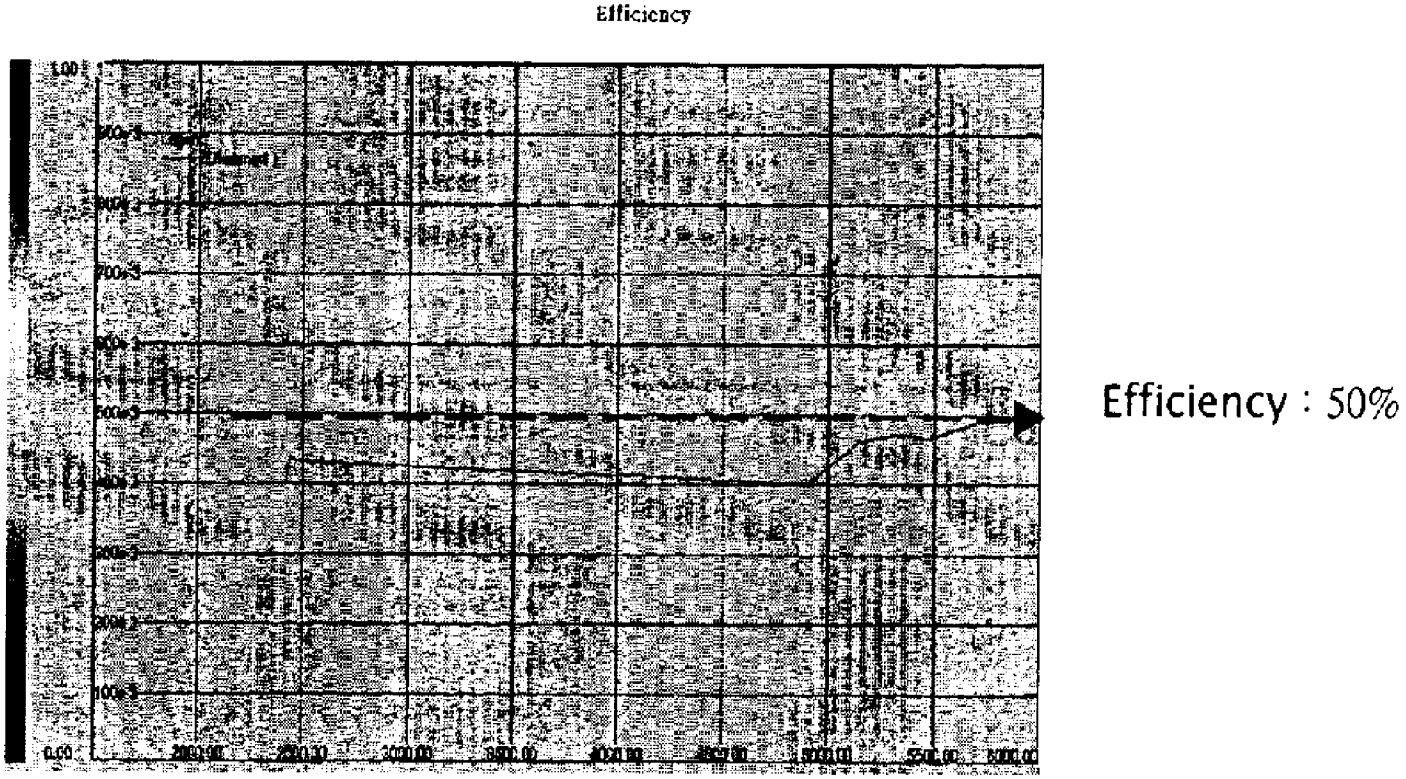
FIG. 7 is a radiation pattern of the planar multi-frequency antenna according to FIG. 1.
Figure 10:
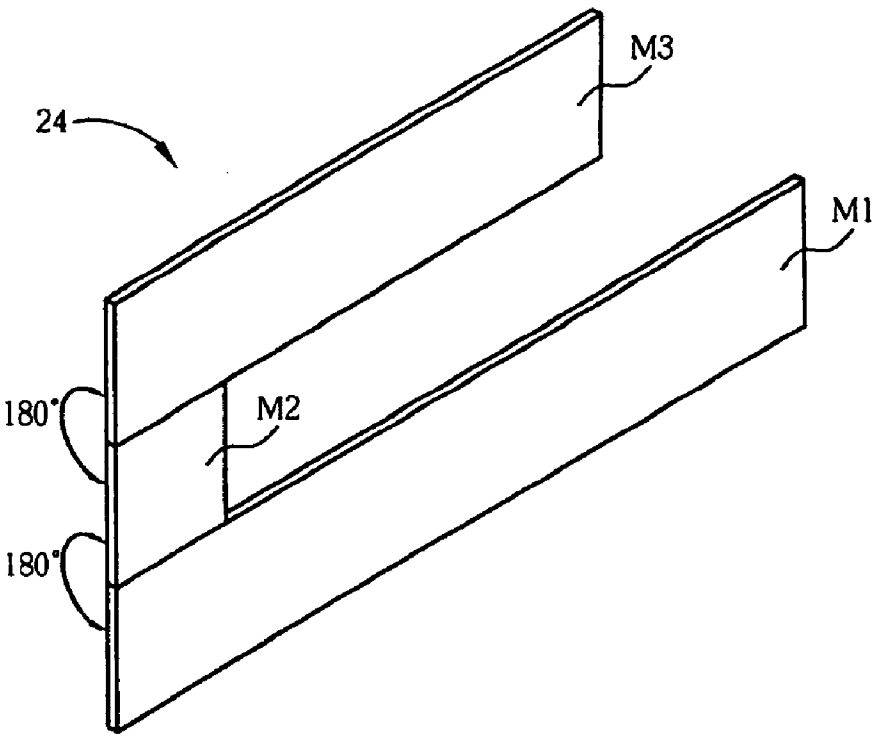
FIGS. 10-13 are schematic diagrams of different architectures of the first U-shaped radiator of the multi-frequency antenna according to FIG. 2.
Figure 11:
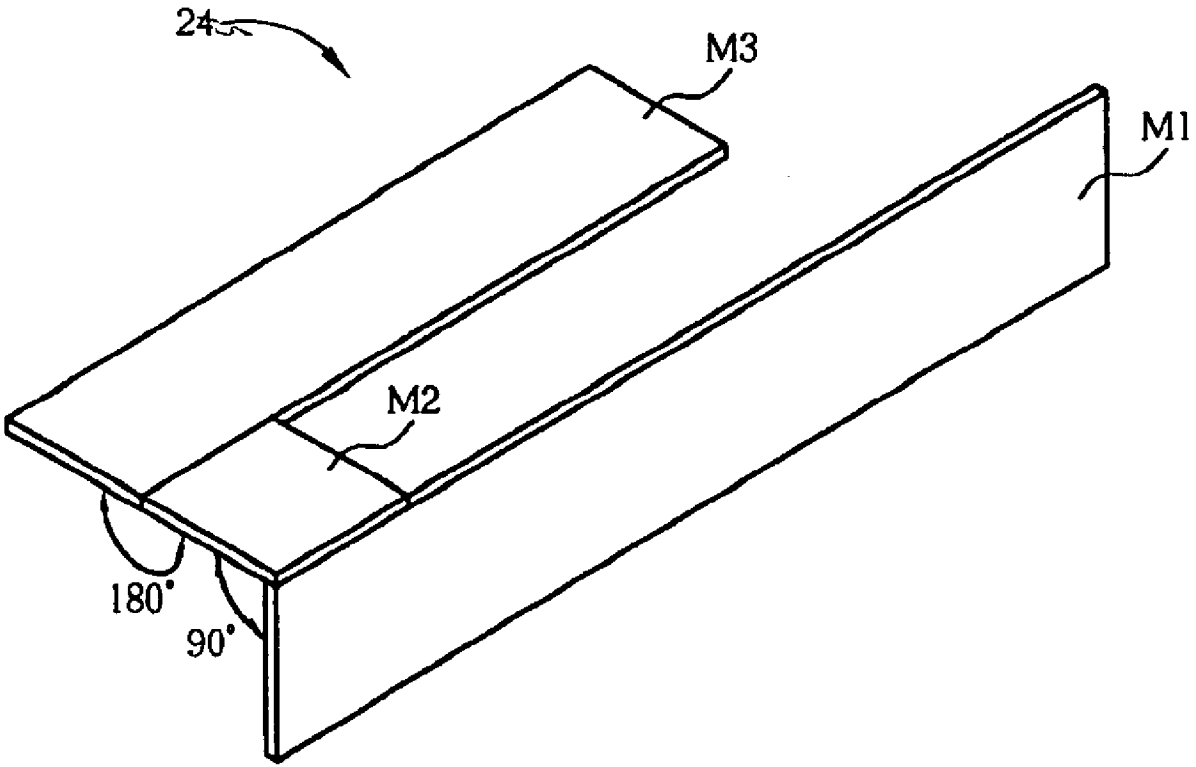
Figure 12:
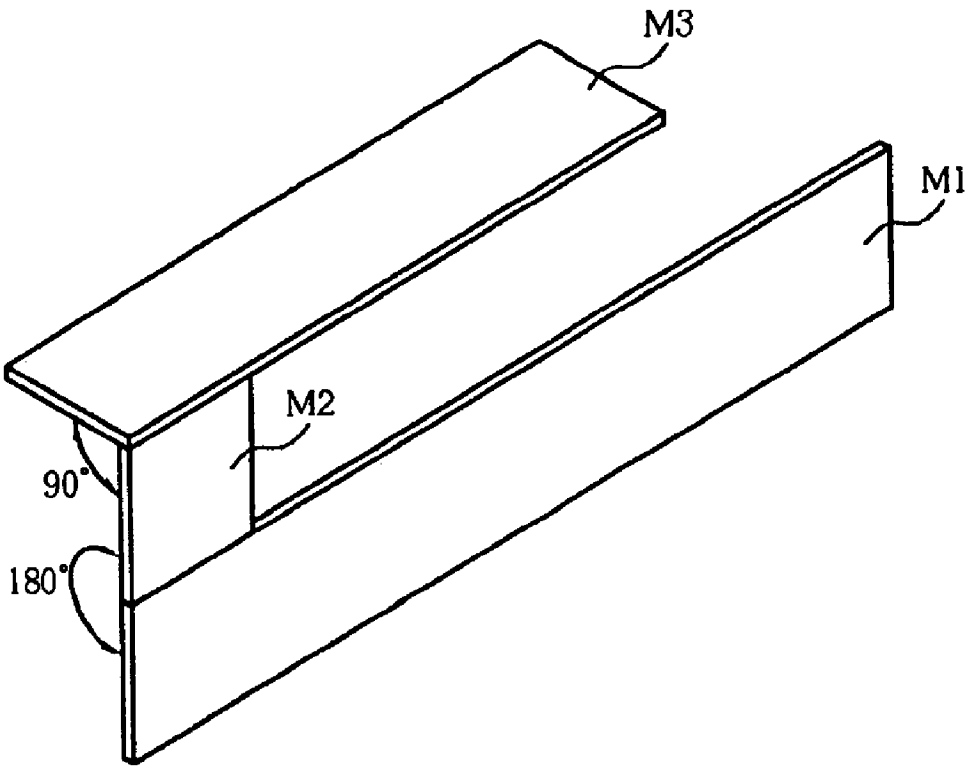
Figure 13:
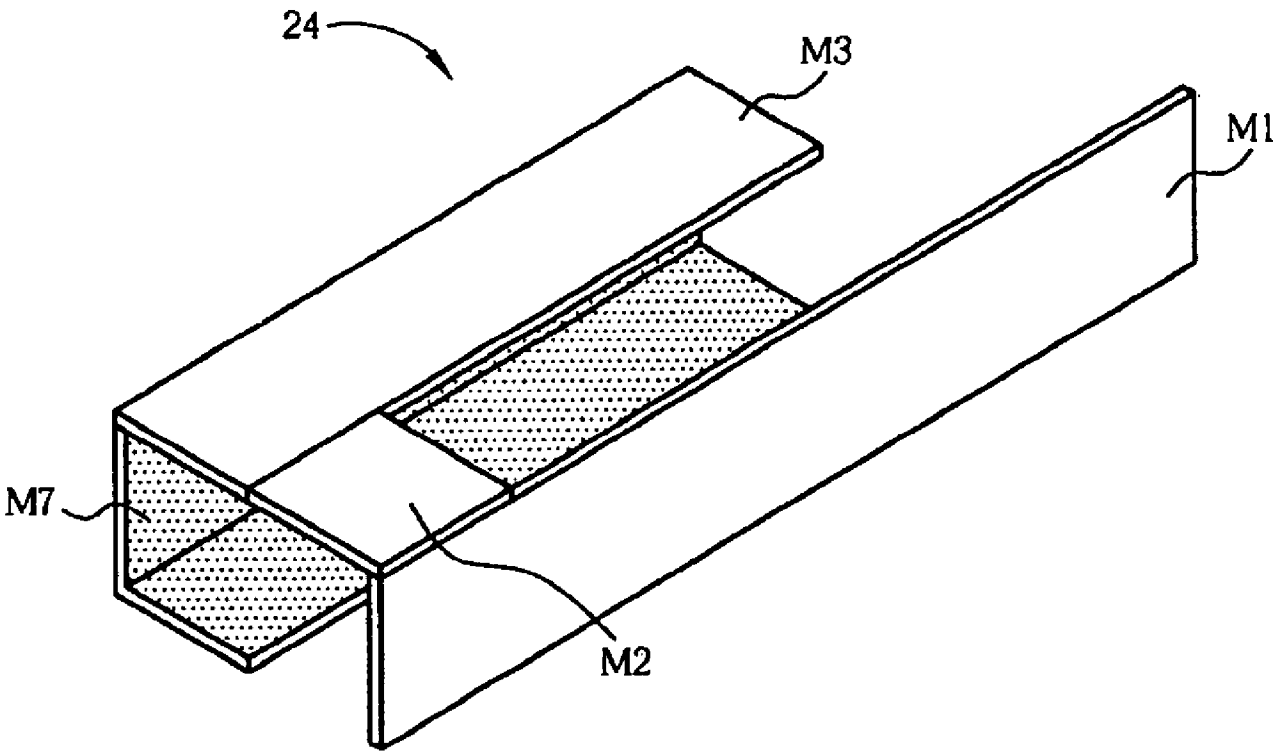

Please refer to FIG. 6 and FIG. 7, which are measured results of the multi-frequency antenna 20 and the planar multi-frequency antenna 10 for radiation efficiency. As experimented in the lower frequency band between 2.4 GHz and 2.5 GHz, the radiation efficiency of the multi-frequency antenna 20 is measured between 51%-55%, and the radiation efficiency of the planar multi-frequency antenna 10 is measured between 40%-44%. As for the higher frequency band between 4.9 GHz and 5.875 GHz, the radiation efficiency of the multi-frequency antenna 20 is approximately between 44%-50%, while the radiation efficiency of the planar multi-frequency antenna 10 is approximately between 40%-49%. Thus, the multi-frequency antenna 20 has better performance in the radiation efficiency than the planar multi-frequency antenna 10 does.

Please continue by referring to FIG. 8 and FIG. 9, which are measured results of the multi-frequency antenna 20 and the planar multi-frequency antenna 10 for average gain in the horizontal plane (as known $\theta=90°$). From the two tables in FIG. 8 and 9, at the same frequencies, the average gain of the multi-frequency antenna 20 is larger by about 1-2 dB than that of the planar multi-frequency antenna 10.

Figure 14:
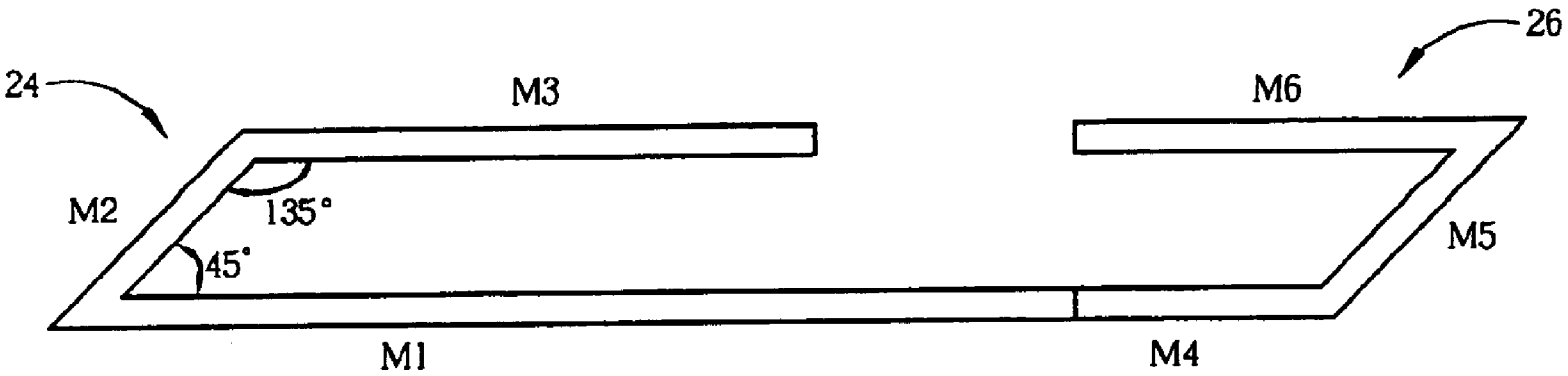
FIG. 14 is a vertical view of the first U-shaped radiator and the second U-shaped radiator in a specific architecture.
Figure 15:
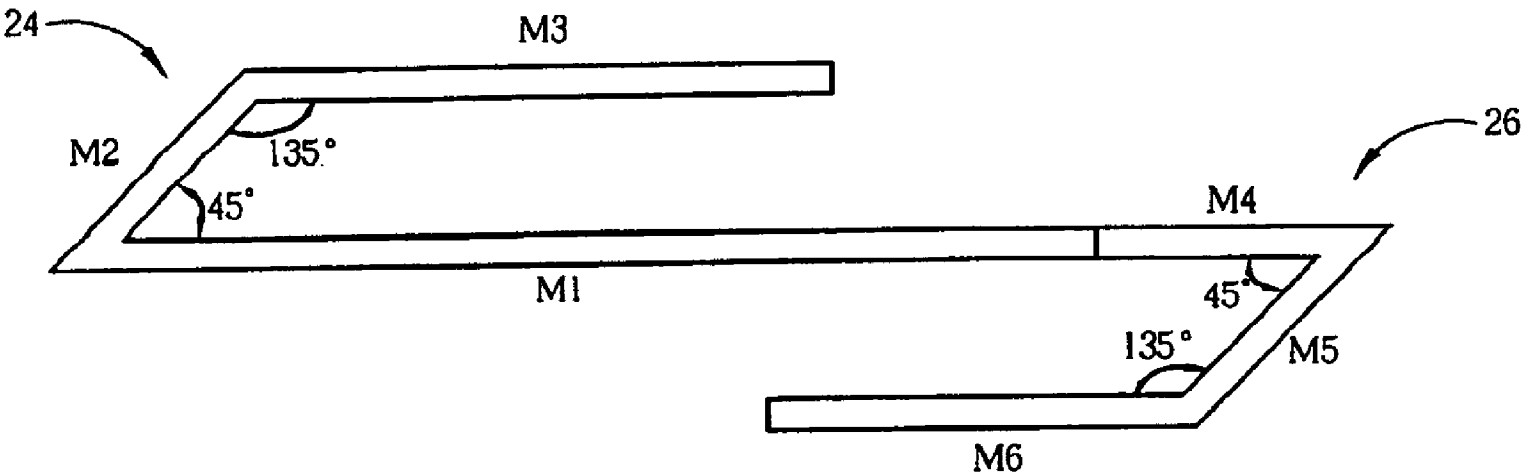
FIG. 15 is a vertical view of the first U-shaped radiator and the second U-shaped radiator in another architecture.
Figure 16:
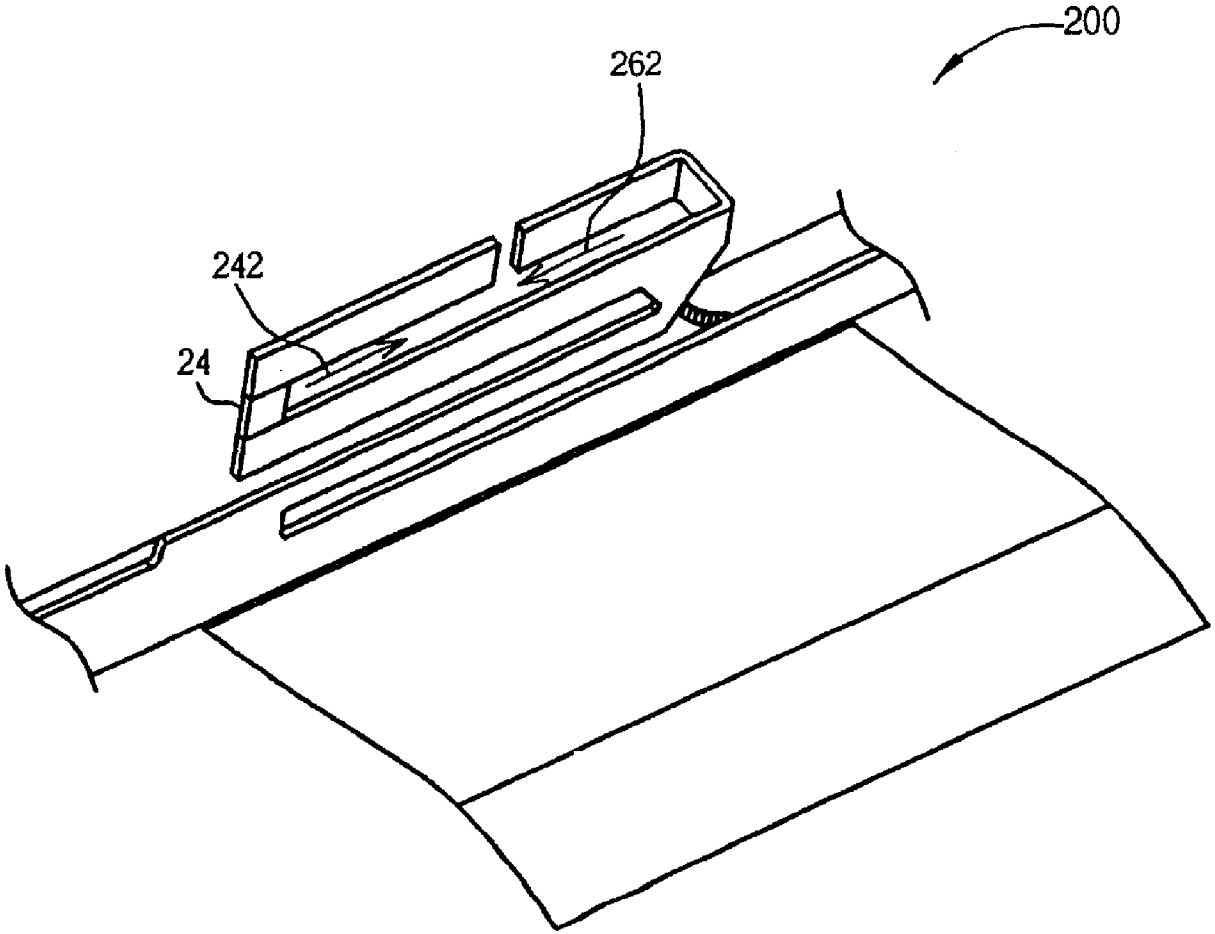
FIG. 16 is a schematic diagram of a multi-frequency antenna according to an embodiment of the present invention.

Note that the first U-shaped radiator 24 and the second U-shaped radiator 26 in FIG. 2 are just considered as an embodiment of the present invention. Those skills in the art can do modifications if necessary. Any modifications making the first gap 242 and the second gap 262 face-to-face or parallel in opposite directions fall within the concept of the present invention. For instance, please refer to FIG. 14-17, which are schematic diagrams of different architectures of the first U-shaped radiator 24. In FIG. 14, the metal bars M1 and M2 form an angle of 180°, and so do the metal bars M2 and M3. As a result, the metal bar M2 is parallel to the metal bar M1, and the metal bar M3 is also parallel to the metal bar M1. In FIG. 15, the metal bars M1 and M2 form an angle of 90°, and the metal bars M2 and M3 form an angle of 180°. That is, the metal bar M2 is perpendicular to the metal bar M1, and the metal bar M3 is parallel to the metal bar M1. In FIG. 16, on the contrary, the metal bars M1 and M2 form an angle of 180°, and the metal bars M2 and M3 form an angle of 90°. In this situation, the metal bar M2 is parallel to the metal bar M1, and the metal bar M3 is perpendicular to the metal bar M1. In FIG. 17, the first U-shaped radiator 24 further includes a metal bar M7 coupled to the metal bar M3 so that the metal bars M3 and M7 form a U-shape. Please note that the modifications above can also be applied to the second U-shaped radiator 26.

Please refer to FIGS. 18 and 19, which are vertical views of different architectures of the first U-shaped radiator 24 and the second U-shaped radiator 26. In FIG. 18, a metal bar formed by the metal bars M1 and M4 can be considered a boundary. Thus, the metal bars M2 and M3 of the first U-shaped radiator 24 form a gap at one side of the boundary, and the metal bars M5 and M6 of the second U-shaped radiator 26 form another gap at the same side of the boundary. For the first U-shaped radiator 24, the metal bars M2 and M3 form an angle of 135°, and the metal bars M2 and M1 form an angle of 45°, thereby paralleling the metal bars M3 and M1. On the contrary, for the second U-shaped radiator 26, the metal bars M5 and M6 form an angle of 45°, and the metal bars M5 and M4 form an angle of 135°, thereby paralleling the metal bars M6 and M4. Unlike FIG. 18, in FIG. 19, the metal bars M2, M3 and the metal bars M5, M6 form a gap respectively at the opposite sides of the boundary. The first U-shaped radiator 24 shown in FIG. 19 is the same as that shown in FIG. 18, while the second U-shaped radiator 26 shown in FIG. 19 is constructed with an angle of 135° formed by the metal bars M5 and M6 and an angle of 45° formed by the metal bars M5 and M4. Therefore, as can be known from the above, the gaps of the first U-shaped radiator 24 and the second U-shaped radiator 26 may be formed face-to-face in parallel or in two opposite, parallel directions.

Please refer to FIG. 20, which is a schematic diagram of a multi-frequency antenna 200 according to another embodiment of the present invention. The multi-frequency antenna 200 has similar architecture to the multi-frequency antenna 20 shown in FIG. 2, and thereby the same elements are labeled with the same symbols. Different from the multi-frequency antenna 20, the multi-frequency antenna 200 utilizes the first U-shaped radiator 24 shown in FIG. 14. Thus, the first gap 242 lies above the metal bar M1, and the second gap 262 lies at a side of the metal bar M4. That is, the first gap 242 and the second gap 262 of the multi-frequency antenna 200 are parallel and opposite, but not on the same plane. Therefore, in the present invention, the two gaps of the two U-shaped radiators are not limited to be opposite face-to-face. The two gaps can also be setup opposite in parallel.

The multi-frequency antenna of the present invention adopts a architecture in order to reduce sizes of the U-shaped radiators and the grounding element for the requirement of low space occupation. In conclusion, the multi-frequency antenna is simple, light and easily-made and besides applied to various wireless LAN standards, such as IEEE 802.11a and IEEE 802.11b. Therefore, the multi-frequency antenna of the present invention has high commercialization value.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A multi-frequency antenna comprising:

a feeding element;

a first U-shaped radiator coupled to the feeding element, the first U-shaped radiator forming a first gap toward the feeding element;

a second U-shaped radiator coupled to the feeding element, the second U-shaped radiator forming a second gap toward the first U-shaped radiator;

a grounding element coupled to a ground end; and a coupling element coupled to the feeding element and the grounding element.

2. The multi-frequency antenna of claim 1, wherein the first U-shaped radiator is formed by bending a metal bar.

3. The multi-frequency antenna of claim 1, wherein the first U-shaped radiator comprises:

a first metal bar coupled to the feeding element forming a first surface;

a second metal bar coupled to the first metal bar forming a second surface; and a third metal bar coupled to the second metal bar forming a third surface.

4. The multi-frequency antenna of claim 3, wherein the second surface is perpendicular to the first surface, and the third surface is parallel to the first surface.

5. The multi-frequency antenna of claim 3, wherein the second surface is parallel to the first surface, and the third surface is parallel to the first surface.

6. The multi-frequency antenna of claim 3, wherein the second surface is perpendicular to the first surface, and the third surface is perpendicular to the first surface.

7. The multi-frequency antenna of claim 3, wherein the second surface is parallel to the first surface, and the third surface is perpendicular to the first surface.

8. The multi-frequency antenna of claim 3, wherein the third surface is parallel to the first surface.

9. The multi-frequency antenna of claim 3, wherein the third surface is perpendicular to the first surface.

10. The multi-frequency antenna of claim 3 further comprising a fourth metal bar coupled to the third metal bar.

11. The multi-frequency antenna of claim 3, wherein the first metal bar, the second metal bar and the third metal bar are formed jointly by a metal bar.

12. The multi-frequency antenna of claim 1, wherein the second U-shaped radiator comprises:

a first metal bar coupled to the feeding element, forming a first surface;

a second metal bar coupled to the first metal bar, forming a second surface; and a third metal bar coupled to the second metal bar, forming a third surface.

13. The multi-frequency antenna of claim 12, wherein the second surface is perpendicular to the first surface, and the third surface is parallel to the first surface.

14. The multi-frequency antenna of claim 12, wherein the second surface is parallel to the first surface, and the third surface is parallel to the first surface.

15. The multi-frequency antenna of claim 12, wherein the second surface is perpendicular to the first surface, and the third surface is perpendicular to the first surface.

16. The multi-frequency antenna of claim 12, wherein the second surface is parallel to the first surface, and the third surface is perpendicular to the first surface.

17. The multi-frequency antenna of claim 12, wherein the third surface is parallel to the first surface.

18. The multi-frequency antenna of claim 12, wherein the third surface is perpendicular to the first surface.

19. The multi-frequency antenna of claim 12 further comprising a fourth metal bar coupled to the third metal bar.

20. The multi-frequency antenna of claim 12, wherein the first metal bar, the second metal bar and the third metal bar are formed jointly by a metal bar.

21. The multi-frequency antenna of claim 1, wherein the first U-shaped radiator is used for transmitting signals conforming to wireless LAN standard IEEE 802.11b developed by the Institute of Electrical and Electronics Engineers (IEEE).

22. The multi-frequency antenna of claim 1, wherein the second U-shaped radiator is used for transmitting signals conforming to wireless LAN standard IEEE 802.11a.

23. The multi-frequency antenna of claim 1, wherein the feeding element is bow-tie shape.

24. The multi-frequency antenna of claim 1 further comprising a feeding line coupled between the grounding element and the feeding element.

25. The multi-frequency antenna of claim 1 further comprising a conduction tape coupled to the grounding element.

* * * * *